US005256039A

United States Patent [19]

Crawford

[11] Patent Number: 5,256,039

[45] Date of Patent: Oct. 26, 1993

[54] REMOTE CONTROLLED MOVEABLE FAN

[76] Inventor: Dale K. Crawford, 14030 Kronblum #212, Hawthorne, Calif. 90250

[21] Appl. No.: 953,741

[22] Filed: Nov. 9, 1992

[51] Int. Cl.[5] ..... F04B 21/00

[52] U.S. Cl. ..... 417/234; 417/229; 416/100; 416/246

[58] Field of Search ..... 417/234, 229, 231, 233; 416/5, 100, 246

[56] References Cited

U.S. PATENT DOCUMENTS

| | | | |
|---|---|---|---|
| 2,611,554 | 9/1952 | Sanders | 416/246 |
| 2,884,075 | 4/1959 | Poon | 417/234 |
| 2,961,152 | 11/1960 | Douglas et al. | 417/234 |
| 3,370,809 | 2/1968 | Leoni | 416/246 |
| 4,120,615 | 10/1978 | Keem et al. | 417/234 |
| 4,732,539 | 3/1988 | Shin-Chin | 416/100 |

*Primary Examiner*—Richard A. Bertsch
*Assistant Examiner*—Alfred Basichas

[57] ABSTRACT

A remote controlled fan is operated by a hand held remote control which controls the power, speed of fan rotation, oscillation of the fan, and movement of the fan. The fan operates on either AC power or batteries. The fan can move forward or rearward or rotate about its vertical axis in response to signals from the remote control unit.

5 Claims, 4 Drawing Sheets

REMOTE CONTROLLED MOVEABLE FAN

BACKGROUND OF THE INVENTION

1. Field of Invention

This invention relates to the field of devices for moving air in enclosed spaces. More particularly it relates to a remotely controllable fan.

2. Description of the Background Art

Modern electronics has provided the consumer with the ability to remotely control a variety of household appliances. However, this ability has not yet been completely exploited with regard to the control of ventilation devices, or more particularly to the control of fans. Prior workers in the field have used remote control devices chiefly for the limited purpose of controlling the speed of fan rotation, Angott, et. al., U.S. Pat. No. 4,538,973, Gilbert, U.S. Pat. No. 4,768,926, or for controlling ancillary related functions, such as a light attached to a fan, Angott et. al., or for transmitting operational state information about the fan to the user via audible and visual signals, Gilbert. Other aspects of fan operation have not yet been made accessible by remote control.

In addition to controlling a fan's speed of operation, it is often necessary to physically relocate the fan in order to increase the degree of ventilation provided, or substantially change the direction of air flow. The ability to move the entire fan via remote control has not previously been available; this ability would allow the user, particularly those who are sick or handicapped to adjust the location of the fan without physically lifting and carrying it. Likewise, while fans are now readily available with controls for oscillating the fan with respect to its supporting structure, such controls are attached to the structure of the fan and must be directly manipulated to change the oscillation settings. Remote control of this operation would further aid in the use of such a fan by an elderly or handicapped person. Finally, while some existing fans can have their fan speed continuously varied over a preset range, this ability is not found on any remote controlled fan. What is needed therefore, is fan that can be moved by remote control. In addition, there is needed a fan whose oscillation period can be adjusted by remote control. Finally there is needed a fan whose fan speed range can be continuously varied over a range of speeds by remote control.

SUMMARY OF INVENTION

In accordance with the present invention, a remote controlled fan is disclosed which can be operated by a hand held remote control unit, or by control switches located on the fan body. The remote control unit transmits infrared, or other, signals for controlling the operation of the fan, including whether the fan is on or off, the speed of the rotation of the fan blades, the speed of the fan's oscillation with respect to the fan's base, the forward and rearward movement of the fan, and the rotation of the fan around its vertical axis. The speed of fan rotation, or the speed of oscillation, can be set to either discrete values, such as slow, medium or fast, or can be continuously variable within a range of values. Conventional speed and oscillation control units are used. Forward and rearward motion is provided by the use of a low rpm fixed speed motor connected to a drive shaft and driving wheels. Such movement is made in response to forward or reverse signals received from the remote control unit. Rotational movement is effected by a low rpm motor connected to a wheel, in response to left or right signals from the remote control. The power, speed and oscillation of the fan can also be controlled by switches located on the body of the fan.

DESCRIPTION OF THE PREFERRED EMBODIMENT

Figure 1:
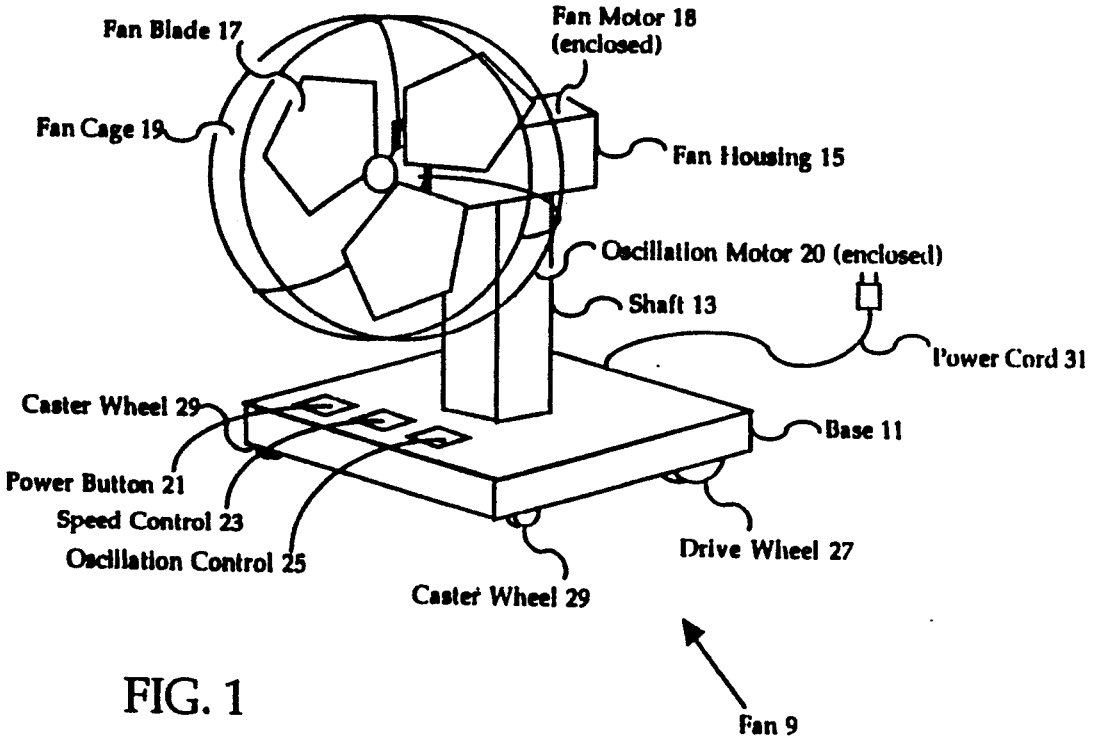
FIG. 1 is a perspective pictorial representation of the fan of the present invention.

Referring now to FIG. 1, there is shown a preferred embodiment of the fan of the present invention. Fan 9 is comprised of base 11 which supports a shaft 13 and fan housing 15. Fan housing 15 encloses fan motor 18 for driving fan blades 17. Shaft 13 encloses oscillation motor 20, for oscillating fan housing 15 with respect to shaft 13 and base 11. Fan blades 17 are covered by fan cage 19 for preventing the user from contacting fan blades 17 during operation; fan cage 19 is removable for servicing fan 9 or for cleaning fan blades 17.

Base 11 further contains on its top surface immediately accessible to the user during operation, three switches, power button 21, for turning the fan on or off, speed control 23, for varying the rotational speed of fan blades 17, and oscillation control 25, for varying the oscillation speed of fan housing 15 with respect to base 11. Speed control 23 can vary the rotational speed of fan blades 17 through conventional electrical means for selecting one of several fixed speeds. Similarly, oscillation control 25 can vary the speed of the oscillation of fan housing 15 over one of several fixed speeds, or in alternative embodiments, over a range of speeds.

The operating speeds of fan motor 18 and oscillation motor 20, and the power status of fan 9 can be controlled by remote control 51, described below. Fan 9 can be moved longitudinally by drive wheels 27, and rotated axially in response to signals from remote control 51. Caster wheels 29 provide balance during movement and rotation.

Figure 2:
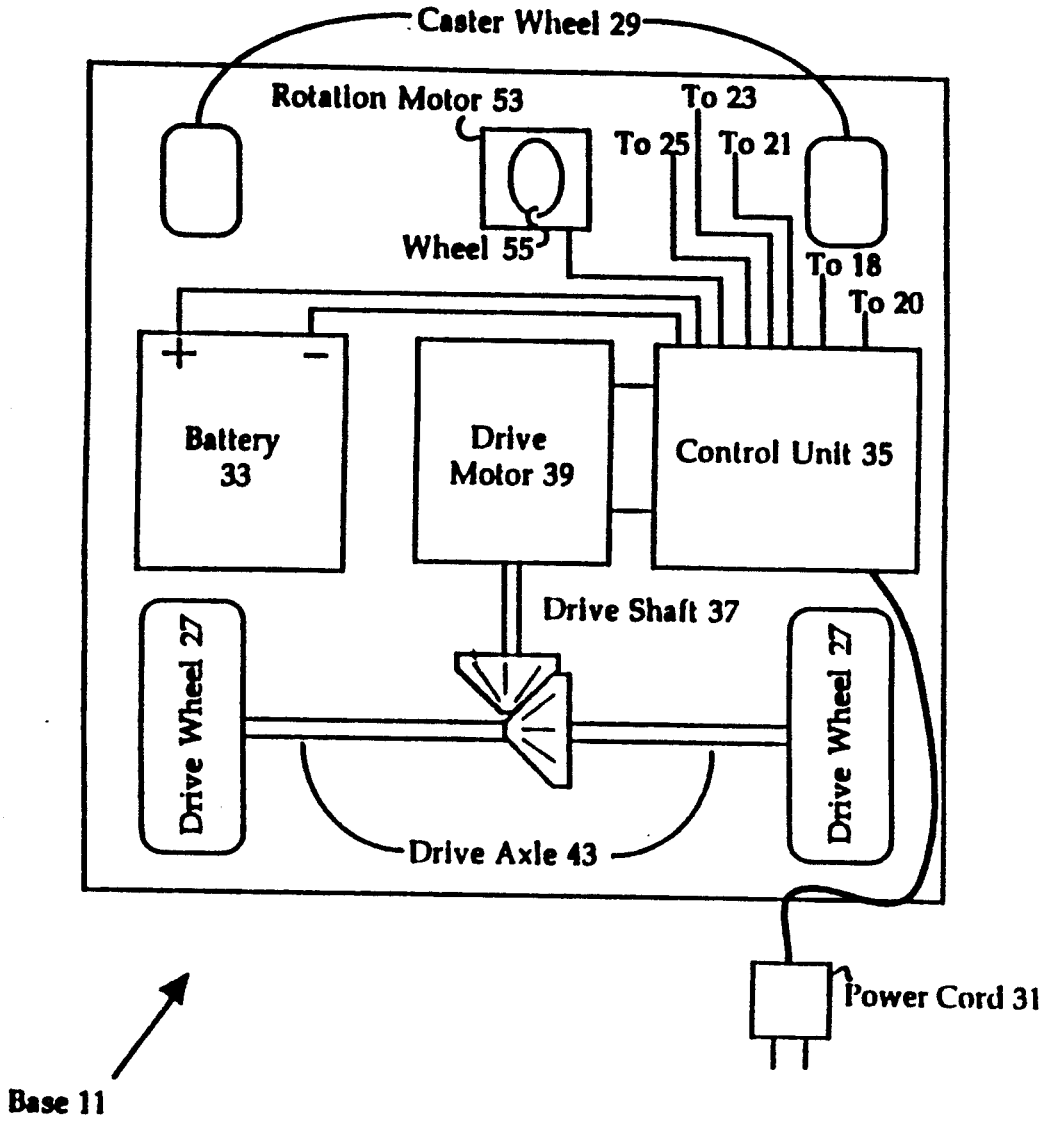
FIG. 2 is block diagram illustrating the control and motive elements contained in the present invention.

Referring now to FIG. 2, base 11 contains the control and movement elements of the present invention. The present invention can operate on either DC power supplied by battery 33, or AC power supplied by power cord 31. Control unit 35 contains means for switching between these power sources in response to the presence or absence of power from either power cord 35 or battery 33. Battery 33 can be either a non-rechargeable or rechargeable battery commonly available; if battery 33 is rechargeable, then during operation under AC power, control unit 35 can control the recharging of battery 33 from supplied AC power.

Control unit 35 is connected to and operates fan motor 18, oscillation motor 20, drive motor 39, and rotation motor 53 in responses to signals from remote control 51. In response to such signals from remote control 51, control unit 35 increases or decreases the operating speed of fan motor 18 and oscillation motor 20. Control unit 35 also turns on or off fan 9 in response to signals from remote control 51.

Drive motor 39 is a fixed low rpm motor capable of rotating either clockwise or counterclockwise in response to forward or rearward signals (not necessarily respectively) received from control unit 35. In alternative embodiments drive motor 39 can be a continuously variable motor. Drive motor 39 is connected to drive axle 43 by a fixed bevel gear attached to drive shaft 37, or equivalent gear means, for rotating drive axle 43. Each end of drive axle 43 terminates with a drive wheel 27. During the transmission of forward or reverse movement signals from remote control 51, drive axle 43 rotates either forwardly or reversely. This causes base 11 to move forward or rearward as appropriate. Caster wheels 29 freely rotate to allow such forward or rearward movement. Wheel 55 rolls freely to allow such forward or rearward movement.

The rotation of base 11 is effected by rotation motor 53 connected to wheel 55. During the transmission of left or right rotation signals from remote control 51, rotation motor 53 rotates to the left and right, orienting and rolling wheel 55 as appropriate. Caster wheels 29 rotate freely in response to this rotational movement and provide a stable balance for fan 9. In an alternative embodiment, when remote control 51 signals forward or reverse movement, rotation motor 53 can be activated to return to a neutral position with respect to the longitudinal axis of base 11, thereby ensuring that forward or reverse movement is in a straight line. While fan 9 is operating under AC power supplied by power cord 31, its radius of movement is limited by the length of power cord 31, which should be of sufficient length to allow an appropriate range of movement with respect to the operating environment.

Figure 3:
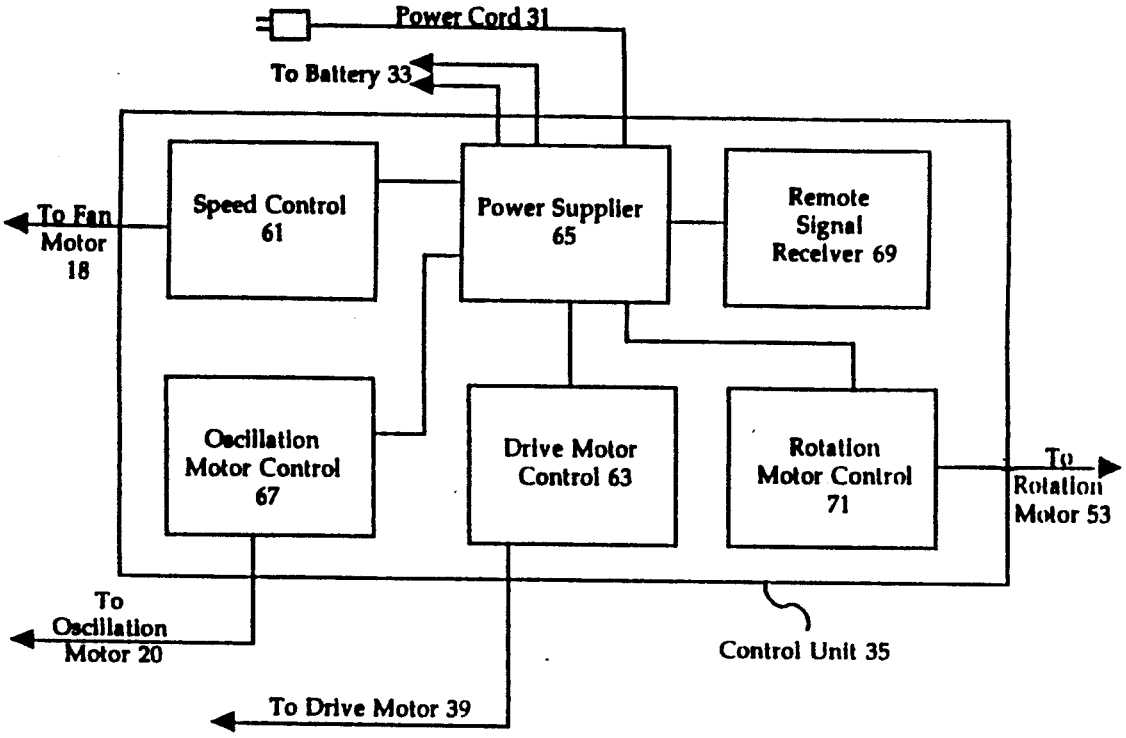
FIG. 3 is a block diagram illustrating the components of the control element described in FIG. 2 above.

Referring now to FIG. 3, there is shown control unit 35, described in FIG. 2 above, for receiving remote control signals from remote control 51 and transmitting the appropriate control signals to the various components of fan 9 described above. Control unit 35 comprises power supplier 65, speed control 61, remote signal receiver 69, oscillation motor control 67, rotation motor control 71, and drive motor control 63. Remote signal receiver 69 receives remote signals from remote control 51 and sends the appropriate control signals to power supplier 65. Power supplier 65 receives power from either battery 33 or power cord 31 and distributes such power to the aforementioned elements in response to signals from remote signal receiver 69. Power supplier 65 also converts AC power from power cord 31 for recharging battery 33, where battery 33 is rechargeable. Speed control 61 receives control signals from power supplier 65 for varying the rotational speed of fan blades 17 by adjusting the speed of fan motor 18. Oscillation motor control 67 receives control signals from power supplier 65 for varying the oscillation speed of fan housing 15 by adjusting the speed of oscillation motor 20. Drive motor control 63 also receives control signals from power supplier 65 for varying the direction of rotation of drive motor 39 for moving forward or rearward. Rotation motor control 71 receives control signals from power supplier 65 for varying the direction of rotation of rotation motor 53. Control unit 35 is also attached to power button 21, speed control 23, and oscillation control 25, for controlling the above described functions for these items.

Figure 4:
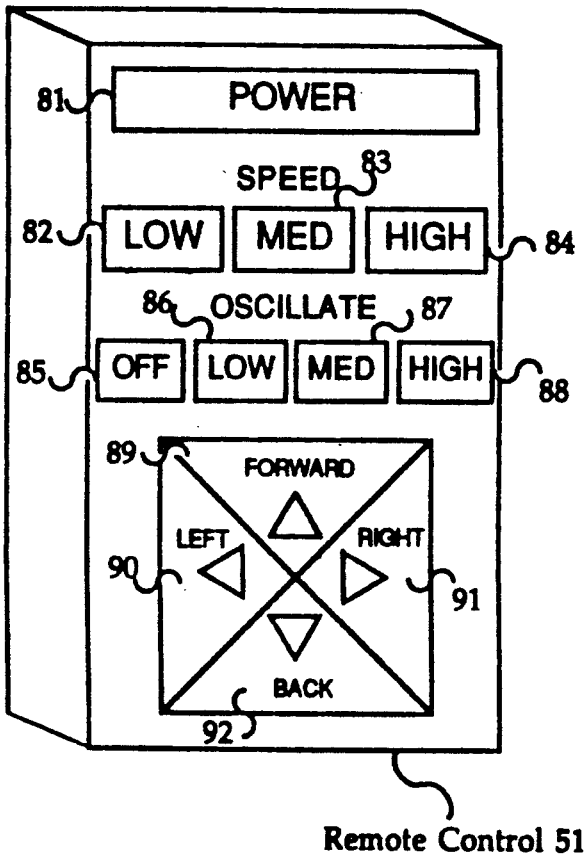
FIG. 4 is a perspective pictorial representation of the remote control transmitting unit of the present invention.

Referring now to FIG. 4, remote control 51 for controlling fan 9 is shown. Remote control 51 is sized to fit easily in an adult hand. Remote control 51 is implemented using infrared, or alternatively other transmitting systems known in the art, and is powered by conventional batteries. Power button 81 turns fan 9 on and off, signaling control unit 35 to supply power to the various control and motive elements described above with respect to FIGS. 1, 2, and 3. The speed of the rotation of fan blades 17 is adjusted by low speed button 82, medium speed button 83, and high speed button 84, each of these selecting a fixed speed. Alternatively, two speed control buttons could be provided, one for selecting a higher speed from a plurality of fixed speeds, and one for selecting a lower speed. In another alternative embodiment, where the speed of rotation of fan blades 17 is continuously variable over a range, such speed could be controlled by two switches, one switch for continuously increasing the speed within the range, the other for continuously decreasing it within the range.

The oscillation speed of fan housing 15 with respect base 11 is selected by low oscillation speed button 86, medium oscillation speed button 87, and high oscillation speed button 88, each of these selecting a fixed speed. Alternatively, two speed control buttons could be provided, one for selecting a higher speed from a plurality of fixed speeds, and one for selecting a lower speed. Oscillation power button 85 turns the oscillation feature on and off.

Longitudinal movement of fan 9 is controlled by forward button 89, and back button 92, which signal control unit 35 to move fan 9 forward and rearward respectively, at a fixed speed. In an alternative embodiment, forward button 89 and back button 92 could signal the forward or rearward movement of fan 9 at a continuously variable speed, for example, in response to application pressure of the button. Rotation of fan 9 about its vertical axis is controlled by left button 90 and right button 91, which signal control unit 35 to rotate fan 9 respectively, at a fixed speed.

I claim:

1. A remotely controlled moveable fan comprising:

a movable base in which the base further comprises a motor means for moving the fan;

a fan motor connected to the base for propelling fan blades; and remote control signaling means for signaling the drive motor means and for thereby controlling the movement of the base.

2. The fan according to claim 1 in which the fan motor is connected to the base by oscillating means for laterally oscillating the fan with respect to the base, and in which the remote control signaling means further comprises signaling means for varying the oscillation speed of the fan.

3. The fan according to claim 1 in which the motor means is connected to a drive wheel for moving the fan along its longitudinal axis in response to drive control signals from the remote control signaling means.

4. The fan according to claim 1 in which the motor means is connected to a wheel for rotating the fan about its vertical axis in response to rotational control signals from the remote control signaling means.

5. The fan according to claim 1 in which the remote control signaling means further comprises:

power control signaling means for controlling the supply of power to the fan;

speed control signaling means for controlling the speed of fan rotation;

forward motion signaling means for directing the motor means to move the fan forward;

backward motion signaling means for directing the motor means to move the fan backwards;

left rotation signaling means for axially rotating the fan to the left; and right rotation signaling means for axially rotating the fan to the right.

* * * * *